United States Patent [19]

Strussion et al.

[11] 4,254,674

[45] Mar. 10, 1981

[54] SOCKET SUPPORT ADAPTER

[76] Inventors: Thomas Strussion, 4999 Jefferson St.; Kermit H. Sweigart, Box 63C, R.D. #3, both of, Bellaire, Ohio 43906

[21] Appl. No.: 46,438

[22] Filed: Jun. 7, 1979

[51] Int. Cl.[3] ..... B25B 17/00

[52] U.S. Cl. ..... 81/57.3; 64/23

[58] Field of Search ..... 81/57.3, 57.29; 64/23; 74/417

[56] References Cited

U.S. PATENT DOCUMENTS

| | | | |
|---|---|---|---|
| 1,420,635 | 6/1922 | Klopper | 81/57.3 |
| 3,138,983 | 6/1964 | Frizzell | 81/57.3 |
| 3,618,340 | 11/1971 | Geisthoff et al. | 64/23 |

*Primary Examiner*—James L. Jones, Jr.

*Attorney, Agent, or Firm*—Williamson, Bains, Moore & Hansen

[57] ABSTRACT

A socket support adapter includes an elongate extensible and retractable body including housings at opposite ends thereof. Male socket elements having gears thereon project from the housings and each male socket element is shaped to accommodate a female socket element or the adapter element of a drive ratchet. An elongate drive shaft is positioned within the adapter body and has gears secured to opposite ends thereof which mesh with gears on the male socket elements. Rotation of one of the male socket elements by a drive ratchet in one direction will rotate the other male socket in the same direction.

4 Claims, 3 Drawing Figures

SOCKET SUPPORT ADAPTER

SUMMARY OF THE INVENTION

This invention relates to a socket support adapter which has special utility in permitting the removal of nuts, bolts and other threaded elements in confined or inaccessible places.

In various kinds of maintenance and repair operations, it is sometimes necessary to remove nuts, bolts and other threaded elements from confined areas. In some instances, it is very difficult, if not impossible, for a mechanic to manipulate a tool in the removal of a nut or bolt.

It is therefore an object of this invention to provide a novel socket support adapter, of simple and inexpensive construction, which is adaptable for use in removing threaded elements, such as nuts, bolts and the like from heretofore inaccessible areas.

More specifically, the novel socket support adapter includes an elongate extensible and retractable body having a pair of gear driven male socket elements extending therefrom which are adapted to engage a female socket element and a drive ratchet assembly, respectively, whereby a nut, bolt, or the like may be readily removed or replaced in a heretofore inaccessible area.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT OF THE INVENTION

Figure 1:
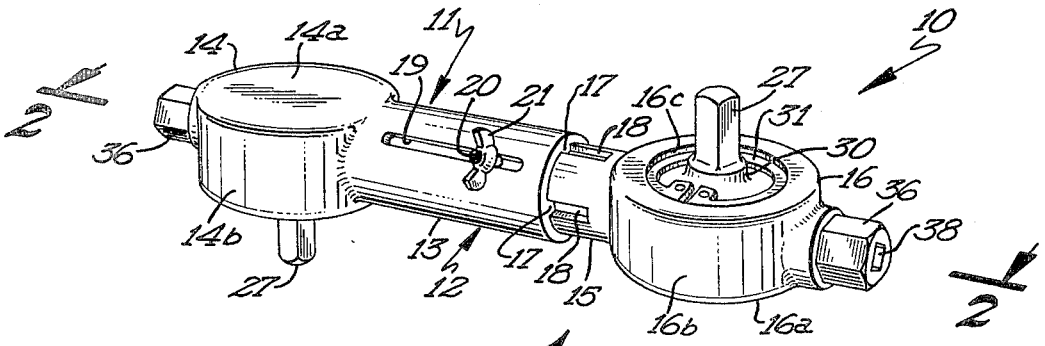
FIG. 1 is a perspective view of the novel socket support adapter.

Referring now to the drawings and more particularly to FIG. 1, it will be seen that one embodiment of my novel socket support adapter, designated generally by the reference numeral 10, is thereshown. The socket support adapter 10 includes an elongate body 11 comprised of two cast body sections 12. One of the body sections 12 includes an elongate generally cylindrical sleeve portion 13 having a generally cylindrical housing 14 integrally formed therewith at one end thereof. The other body section 12 also includes a sleeve portion 15 which is of cylindrical configuration but having a smaller diameter than the sleeve portion 13. The sleeve portion 15 also has a cylindrical housing 16 integrally formed with one end thereof.

The housing 14 includes an end wall 14*a* and an annular wall 14*b*. The housing 14 is also provided with an opening 14*c* opposite the end wall 14*a*. Similarly, the housing 16 is provided with an inner wall 16*a*, an annular wall 16*b* and has an opening 16*c* opposite the end wall 16*a*. It will be noted that the openings 14*c* and 16*c*, respectively, faced in opposite directions.

Figure 3:
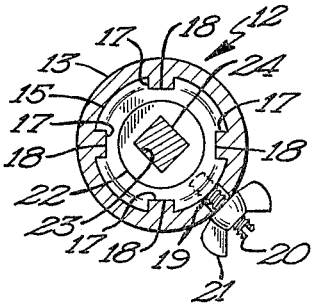
FIG. 3 is a cross-sectional view taken approximately along line 3—3 of FIG. 2 and looking in the direction of the arrows.

Referring now to FIGS. 1 and 3, it will be seen that the sleeve portion 13 is provided with elongate circumferentially spaced apart, inwardly projecting ribs or splines 17. Similarly, the sleeve portion 15 is provided with a circumferentially spaced apart grooves 18 therein which accommodate the splines 17 to thereby permit sliding movement between the sleeve portions but preventing relative rotation therebetween. The sleeve portion 13 is also provided with an elongate longitudinally extending slot 19 therein through which projects a bolt 20, the latter engaging in a threaded recess in the sleeve portion 15. A suitable wingnut 21 engages the bolt 20 for locking the sleeve portions in an adjusted longitudinal position.

Figure 2:
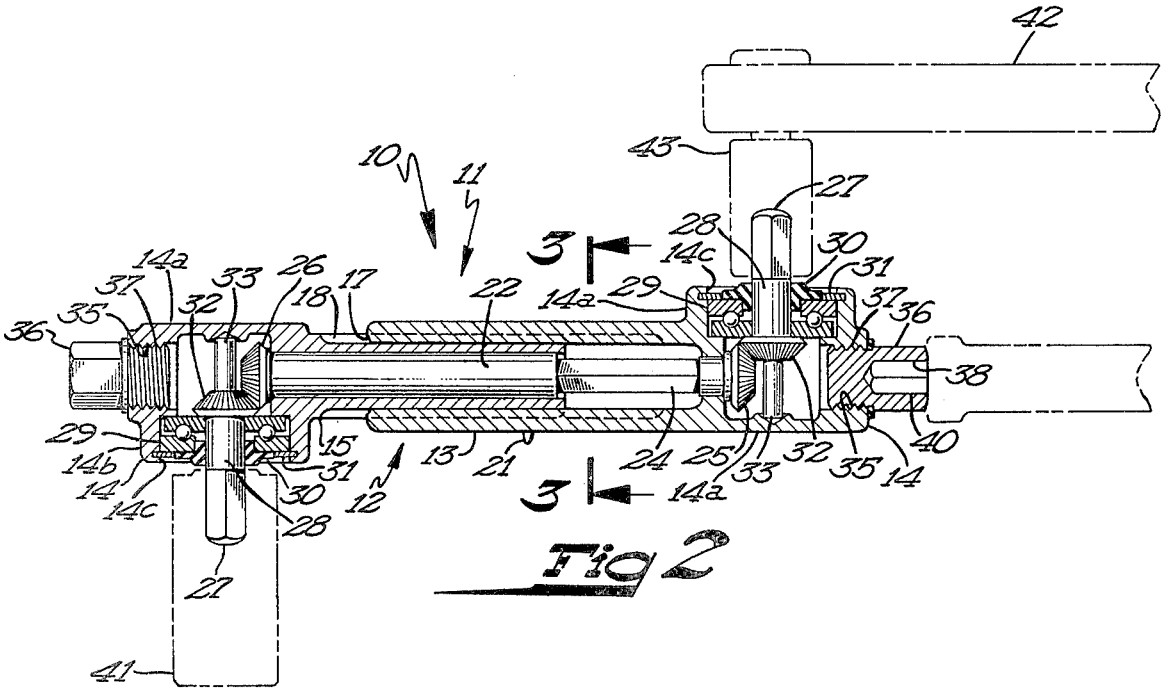
FIG. 2 is a longitudinal cross-sectional view of the socket support adapter.

An elongate telescopic drive shaft is positioned within the body 11 and includes an elongate generally cylindrical section 22 having a bore 23 therethrough which is of rectangular cross-sectional configuration. The bore 23 accommodates an elongate shaft section 24 therein, the latter being of rectangular cross-sectional configuration, as best seen in FIGS. 2 and 3. The shaft section 22 has a bevel gear 25 affixed to the free end thereof while the shaft section 24 has a bevel gear 26 affixed to the free end thereof. It will be seen that the shaft sections can be extended and retracted in telescoping relation when the sleeve portions are extended and retracted relative to each other. It will also be noted that the bevel gear 25 is positioned interiorly of housing 14, and that bevel gear 26 is positioned interiorally of housing 16.

The socket support adapter 10 also includes a pair of male socket elements 27 which are of rectangular cross-sectional configuration each being revolvably mounted in one of the housings 14 and 16. Each male socket element 27 includes a cylindrical portion 28 which is journaled in a bearing assembly 29 mounted in the associated housing adjacent the opening therein. In this regard, it will be noted that the male socket element 27 projects outwardly from its associated housing, and it will further be noted that the male socket elements project in opposite directions with respect to each other. A suitable seal 30 is provided with male socket element and engages the cylindrical portion thereof adjacent the bearing assembly 29. A pair of retaining rings 31 are provided each engaging one of the seals 30 for retaining the seal and bearing assembly within the associated housing.

Each male socket element 27 is provided with a bevel gear 32 positioned within the associated housing and disposed in meshing relation with one of the gears on the elongate drive shaft. In this regard, the bevel gear on one male socket element 27 is disposed in meshing relation for the bevel gear 25 on the shaft section 22 while the bevel gear on the male socket element is disposed in meshing relation with the bevel gear 26 on the shaft section 24. Each male socket element is also provided with an elongate stem 33 which projects axially from the associated bevel gear 32 and engages in a seat 34 for properly positioning the male socket element and the associated bevel gear for proper meshing relation with the bevel gear on the drive shaft.

Each housing 14, 16 is provided with a threaded bore 35 therein which is disposed in coaxial relation with respect to the longitudinal axis of the associated seat portion. Each threaded bore 35 accommodates an end socket member 36 therein. In this regard, the end socket member 36 which is of hexagonal configuration is provided with a threaded plug portion 37 and threadedly engages in associated bore 35. Each socket member 36 is also provided with a socket recess 38 which is of rectangular cross-sectional configuration. The use of removable socket members also facilitates assembly of the socket support adapter. Each end socket member 36 is adapted to receive the male socket element 40 of an elongate steadying handle 39 to prevent movement of the socket support adapter 10 during its use.

In this regard, each male socket element 27 is adapted to accommodate a female socket element 41 of conventional construction, the female socket element having a socket recess therein and adapted to fit a nut, bolt or other threaded member of predetermined size and configuration. Each male socket element 27 is also adapted to accommodate the adapter element 43 of a conventional drive ratchet handle 42 which is used to rotate the male socket element in a well known manner. With this arrangement, it will be seen that when one of the male socket elements 27 is rotated by drive ratchet handle 42 in a predetermined direction, the other male socket element will be rotated in the same direction as a result of the drive through the drive shaft.

In use, when it is desirable to move a nut or bolt from an inaccessible area, a user will select the appropriate female socket element and apply the element to one of the male socket elements 27. The female socket elements may then be disposed in engaging relation with a nut or bolt to be removed even if the nut or bolt is located in an inaccessible area. In the event that the user must extend the length of the socket support adapter 10 in order to manipulate the ratchet handle 42, this may be readily done. A steadying handle 39 may be used to prevent the socket support adapter during manipulation of the drive ratchet. Thereafter, the user may drive the other male socket element by ratchet handle 42 in a well known manner. It is important to point out that rotation of the drive male socket element rotates the driven male socket element in the same direction thereby giving the user a better sense of control during the loosening or tightening operation.

It has been found that the present socket support adapter 10 is especially adapted for use with automotive vehicles for removing or replacing threaded elements such as nuts or bolts often located in confined or substantially inaccessible areas. Conventional socket wrenches simply cannot be used to remove and replace nuts and bolts in such confined areas.

It will therefore be seen from the foregoing paragraphs, that I have provided a novel socket support adapter, which is not only of simple and inexpensive construction, but one which functions in a more efficient manner than any heretofore known comparable devices.

It is anticipated that various changes can be made in the size, shape and construction of the socket support adapter device disclosed herein without departing from the spirit and scope of the invention as defined by the following claims.

What is claimed is:

1. A socket support adapter comprising:

a body including a pair of telescoping body sections each including an elongate sleeve portion having a generally cylindrical housing affixed to one end thereof, the sleeve portions being longitudinally extensible and retractable with respect to each other, an elongate shaft comprising a pair of elongate telescoping shaft sections journaled in said body for rotation relative thereto, said shaft sections being longitudinally extensible and retractable with respect to each other when said body sections are longitudinally shifted, a pair of gears each being secured to one of said shaft sections for rotation therewith and each gear being positioned interiorly of one of said housings, a pair of substantially identical male socket elements each being journaled in one of said housings for rotation relative thereto, said male socket elements being disposed substantially normal to the longitudinal axis of said shaft and each male socket element projecting exteriorly of its associated housing in a direction opposite of the other male socket element, each male socket element being shaped and dimensioned to engage a female socket element or the adapter element of a drive ratchet, a pair of gears positioned interiorly of one of said housings and each being secured to one of said male socket elements for rotation therewith, the gear on each male socket element meshing with one of the gears on said shaft whereby when one of the said male socket elements is rotated in a predetermined direction, the other socket element will be rotated in the same direction.

2. The socket support adapter as defined in claim 1 wherein each cylindrical housing is provided with an end socket member having a socket recess therein and projecting therefrom in substantially longitudinal alignment with the associated sleeve portion, each end socket member being adapted to receive the male socket element of a steadying handle to prevent movement of the socket support adapter during use thereof.

3. The socket support adapter as defined in claim 1 and cooperating means on said sleeve portions preventing rotation of the latter during rotation of said shaft sections.

4. The socket support adapter as defined in claim 3 and cooperating locking means on said sleeve portions for locking said sleeve portions and shaft sections in an adjusted longitudinal position.

* * * * *